United States Patent [19]

Stohlquist

[11] 4,441,664

[45] Apr. 10, 1984

[54] APPARATUS FOR FEEDING WEB MATERIAL FROM A SUPPLY ROLL

[75] Inventor: Roger H. Stohlquist, Rockford, Ill.

[73] Assignee: Anderson Bros. Mfg. Co., Rockford, Ill.

[21] Appl. No.: 402,137

[22] Filed: Jul. 26, 1982

[51] Int. Cl.[3] ..... B65H 17/22; B65H 23/08; B65H 23/16; B65H 25/04

[52] U.S. Cl. ..... 242/75.42; 226/35; 226/44; 226/111; 226/174; 226/183

[58] Field of Search ..... 242/75.2, 75.4, 75.41, 242/75.42, 75.45, 156.1; 226/24, 34, 35, 44, 108, 111, 168, 174, 178, 183, 199

[56] References Cited

U.S. PATENT DOCUMENTS

| | | | |
|---|---|---|---|
| 233,450 | 10/1880 | Wickham | 242/75.42 |
| 2,444,785 | 7/1948 | Rackett | 226/174 X |
| 2,660,426 | 11/1953 | Griner | 226/34 X |
| 2,814,486 | 11/1957 | Gurley et al. | 226/34 |
| 2,918,769 | 12/1959 | Anderson et al. | 53/546 |
| 3,045,405 | 7/1962 | Anderson et al. | 53/550 |
| 3,061,227 | 10/1962 | Peterson | 242/75.42 |
| 3,184,825 | 5/1965 | Jones | 226/183 X |
| 3,700,153 | 10/1972 | Delair et al. | 226/174 X |
| 3,704,820 | 12/1972 | Frederick et al. | 226/44 X |
| 3,985,277 | 10/1976 | Wright | 226/183 X |
| 4,004,400 | 1/1977 | Anderson et al. | 53/182 R |
| 4,231,560 | 11/1980 | Stohlquist et al. | 493/29 |

FOREIGN PATENT DOCUMENTS

| | | | |
|---|---|---|---|
| 1248724 | 8/1967 | Fed. Rep. of Germany | 226/108 |

*Primary Examiner*—Leonard D. Christian
*Assistant Examiner*—Joseph J. Hail, III
*Attorney, Agent, or Firm*—Vernon J. Pillote

[57] ABSTRACT

An apparatus for feeding web material from a supply roll to processing equipment of the type that exerts an intermittent pulley force on the web during intermittent advance through the processing equipment. The web feed apparatus includes a brake for controlling unwinding rotation of the web supply roll which is operated under the control of a dancer to decrease the braking action when the web is fed at a rate faster than the rate at which it unwinds from the supply roll. The web feed apparatus also includes web feed rollers arranged to drive both sides of a folded web while both sides of the web are under the same tension.

4 Claims, 7 Drawing Figures

APPARATUS FOR FEEDING WEB MATERIAL FROM A SUPPLY ROLL

BACKGROUND OF THE INVENTION

Some web processing machines, for example article wrapping machines of the type disclosed in U.S. Pat. Nos. 2,918,769; 3,045,405 and 4,004,400, exert an intermittent pulling force on the web to advance it through the processing machine in step fashion. U.S. Pat. Nos. 2,918,769 and 4,231,560 disclose web unwind stands for feeding webs from a supply roll through a longitudinal web folder to such intermittent advance web processing machines at a rate correlated with the rate of advance of the web by the processing machine. In U.S. Pat. No. 2,918,769, the web supply roll is supported on a pair of drive rollers that are connected through a clutch mechanism to a continuously rotating drive shaft, and the clutch mechanism is operated by a dancer responsive to the tension in the web exiting from the supply roll to start and stop the drive rollers. This supply roll drive is not only relatively complex and expensive to manufacture, but is also subject to wear due to the frequent starting and stopping of the drive rollers. In U.S. Pat. No. 4,231,560 the web is passed from the supply roll over a dancer and part way around an inlet web feed roll before passing to the longitudinal web folders. This apparatus had no provision for controlling unwinding rotation of the web supply roll and, when the web feed was interrupted, the inertia of the web supply roll could cause continued rotation of the supply roll sufficient to allow the web to become slack. It was found that the web in the prior web feed apparatus would sometimes wander or fail to track properly as it passed through the longitudinal folder, and it is believed that the intermittent slackening of the web was a cause of such wandering or improper tracking of the web.

In both U.S. Pat. Nos. 2,918,769 and 4,231,560, feeding of the longitudinally folded web was effected by passing the folded web part way around a feed roller. However, it was found that some wrinkling and creasing occurred when feeding some longitudinally folded webs, particularly relatively heavier weight webs. When a longitudinally folded web is wrapped part way around a roller, the inner layer tends to become slack while the outer layer is tensioned, and it is believed that feeding a folded web by driving the slack inner layer is a cause of such wrinkling and creasing.

Controlling unwinding rotation of a web from a supply roll to an intermittent advance type web processing machine presents special problems. A constant braking action on the web supply rolls is not satisfactory in such applications since constant braking, if adjusted to prevent coasting of the web supply roll when the web feed was interrupted, would correspondingly impede feeding of the web during a feed cycle. Further, the inertia of the web supply rolls varies with the size of the rolls and a constant braking action sufficient to prevent coasting of a full roll would become excessive when the roll size decreased.

SUMMARY OF THE INVENTION

It is an object of the present invention to provide an apparatus for feeding webs to a processing machine of the type that exerts an intermittent pulling force on the web, and which controls braking of the web supply roll during feeding of the web material to decrease braking of the supply roll when the web is withdrawn at a rate faster than the web unwinds from the supply roll and vice versa, and which varies the braking action in accordance with the size of the supply roll to decrease the braking action as the size of the supply roll decreases.

Accordingly, the present invention provides an apparatus for feeding a web of material from a supply roll to processing equipment of the type that exerts an intermittent pulling force on the web during intermittent advance through the processing equipment, which apparatus includes a support frame, means for supporting a supply roll of web material on the frame for unwinding rotation, web loop forming means including web loop guide means mounted at a stationary location on the frame and dancer means mounted on the frame for movement toward and away from the loop guide means and adapted to form a variable size loop in the web passing between the dancer means and the loop guide means, a flexible brake band means, means anchoring one end of the brake band means on the frame and means guiding the other end of the brake band means to cause the brake band means to extend part way around the periphery of the supply roll, brake applying means including a longitudinally flexible member connected at one end to the dancer means and at its other end to the other end of the brake band means and constructed and arranged to draw the brake band means against the periphery of the supply roll when the dancer means moves to a position away from the loop guide means, the dancer means being yieldably biased a direction away from the loop guide means to apply tension through the longitudinally flexible member to the brake band means, the dancer means being constructed and arranged to move toward the loop guide means and reduce tension applied to the brake band means when the web is drawn from the loop forming means at a rate faster than the web unwinds from the supply roll, with outlet web feed roller means engageable with the web after it exits from the web loop forming means and operative when a pull is exerted on the web exiting from the web feed roller means to draw the web from the web loop forming means.

Another object of this invention is to provide an apparatus for withdrawing a web of material from a supply roll longitudinally folding the web, and feeding the longitudinally folded web to processing equipment of the type that exerts an intermittent pulling force on the web, and which effectively avoids wrinkling and creasing of the longitudinally folded web during feeding of the same.

Accordingly, the invention also provides an apparatus for feeding a web of material from a supply roll to processing equipment of the type that exerts an intermittent pulling force on the web, which apparatus includes a support frame, means for supporting a supply roll of web material on the frame for unwinding rotation, web loop forming means including loop guide means and dancer means mounted on the frame for movement toward and away from the loop guide means and adapted to form a variable size loop in the web passing between the dancer means and the loop guide means, brake means for controlling unwinding rotation of the supply roll, means connecting the brake means to the dancer means and constructed and arranged to apply the brake means when the dancer means moves to a position away from the loop guide means and to release the brake means when the web is drawn from the loop forming means at a rate faster than the web unwinds from the supply roll, web feed roller means engageable with the web after it exits from the web loop forming means and operative when a pull is exerted on the web exiting from the web feed roller means to draw the web from the web loop forming means, web folding means engaging the web at a location between the web loop forming means and the web feed means for longitudinally folding the web as it passes thereover to form a longitudinally folded web, the web feed roller means including first and second relatively parallel feed rollers and an exiting web guide roller, means mounting the first web feed roller on the frame for axial rotation at one side of the path of travel of the folded web exiting from the web folding means, lever means mounted on the frame for pivotal movement about an axis at the other side of the path of travel of the folded web, means mounting the second feed roller on one end of the lever means for movement along a path generally perpendicular to the path of travel of the folded web toward and away from the first web feed roller, means mounting the exiting guide roller on the other end of the lever means with its periphery generally tangent to a plane extending between the first and second web feed rollers to engage the folded web exiting from the first and second feed rollers, means for driving the first and second feed rollers at the same speed and in directions to advance the folded web, and exiting web guide means engageable with the folded web after it exits from the exiting guide roller for guiding the folded web in an exiting direction having a substantial component laterally of the other side of the path to shift the second feed roller toward the first feed roller in response to tension on the folded web exiting from the exiting web guide roller.

These, together with other objects and advantages of this invention will be more readily understood by reference to the following detailed description, when taken in connection with the accompanying drawings wherein.

The web unwinding apparatus of the present invention is generally adapted for use in feeding a web of material from a supply roll to web processing equipment of the type that exerts an intermittent pulling force on the web during intermittent advance through the processing equipment and is particularly designed for use in the multi-lane packaging apparatus disclosed in the co-pending U.S. patent application of Roger H. Stohlquist, Jonathan G. Brown, Kenneth V. Baker, filed Dec. 14, 1981, Ser. No. 330,217, the disclosure of which is incorporated herein by reference. It is to be understood, however, that the apparatus for feeding a web can be adapted for use with other packaging apparatus such as disclosed in the aforementioned U.S. Pat. Nos. 2,918,769; 3,045,405 and 4,004,400.

Figure 2:
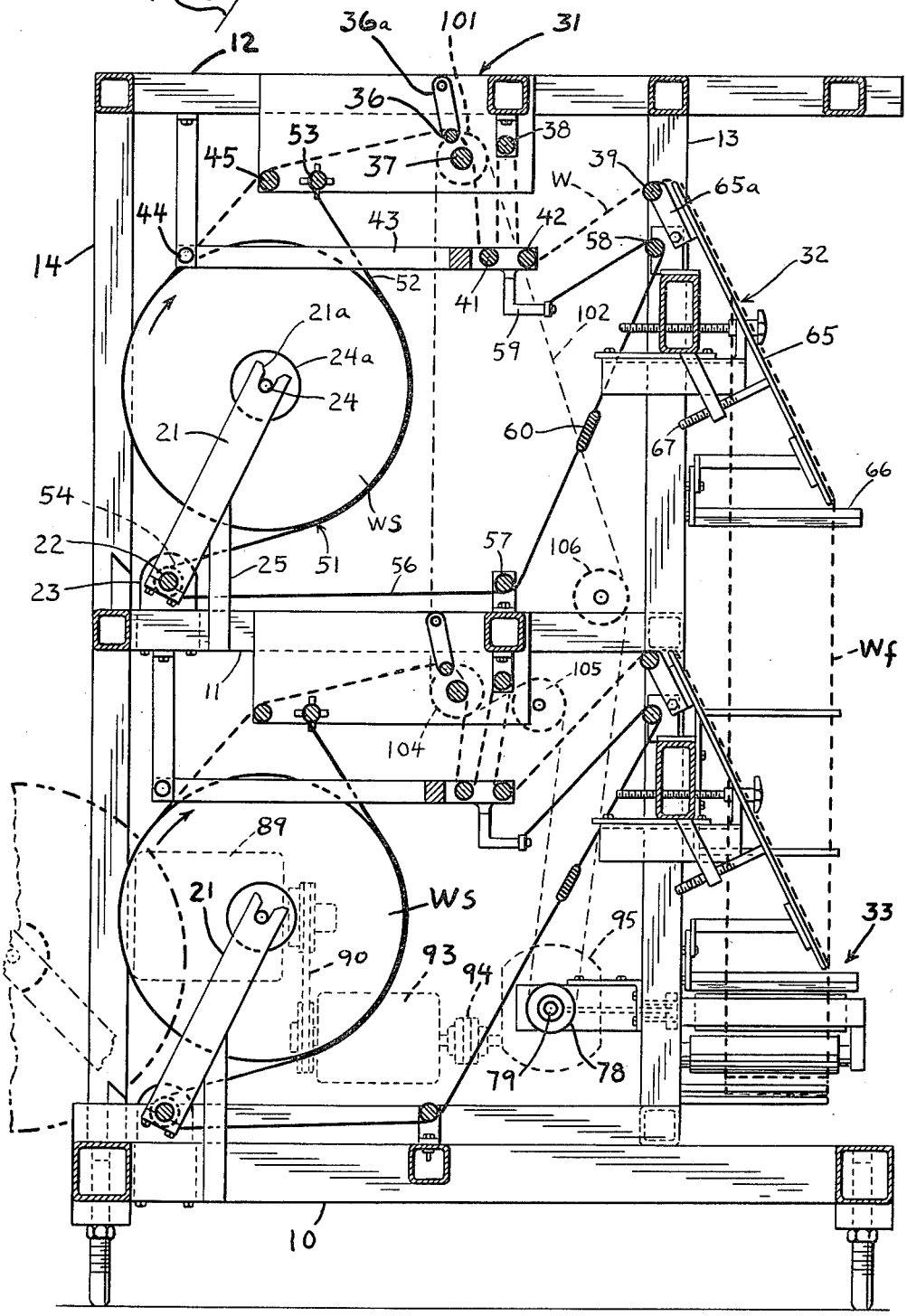
FIGS. 2 and 3 are vertical sectional views through the web feed apparatus illustrating the apparatus in different moved positions.
Figure 3:
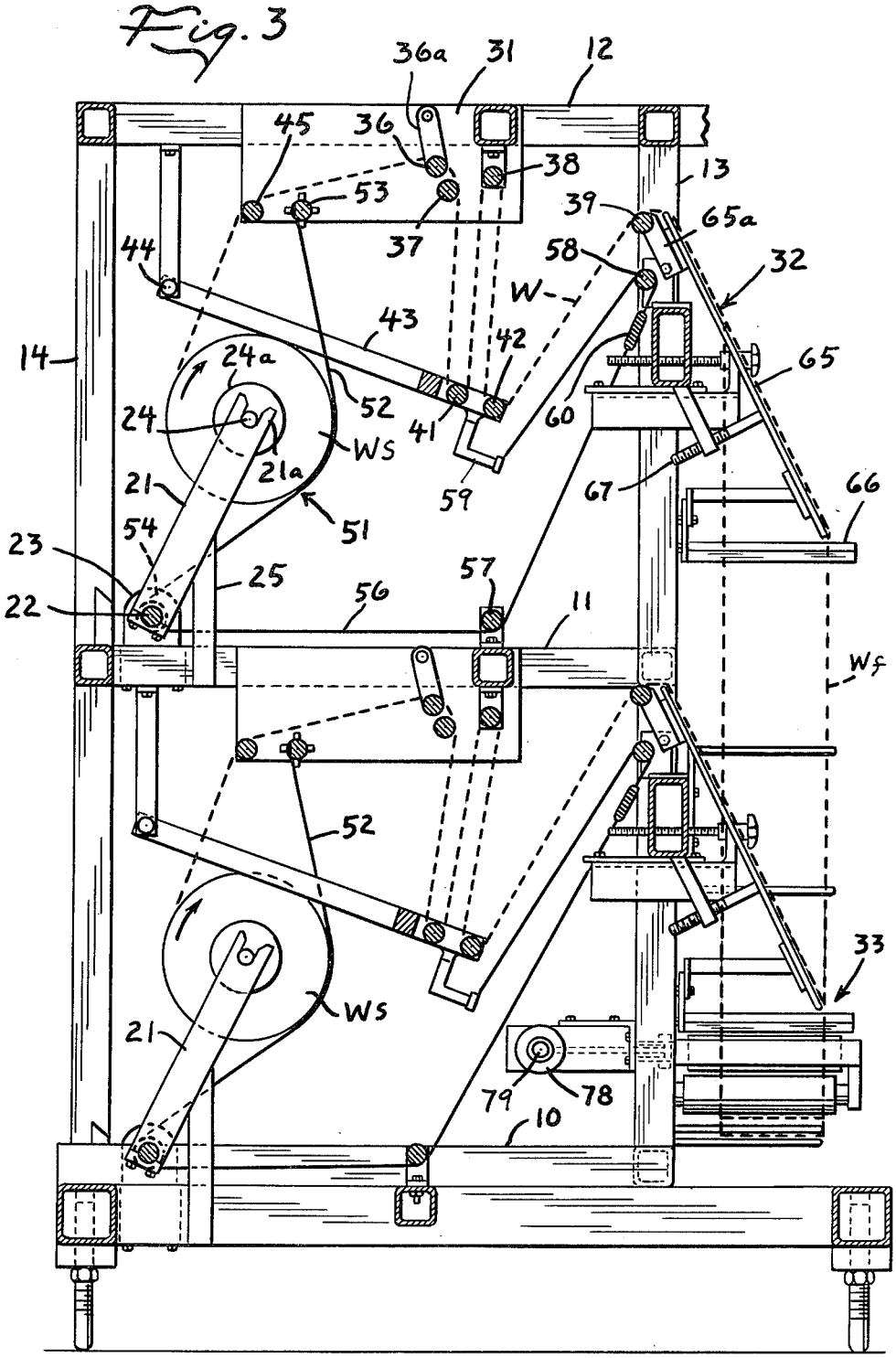

The web feed apparatus includes a support frame having lower, intermediate and upper frame sections 10, 11, and 12 respectively, and which are interconnected by front and rear uprights 13 and 14. The packaging machine disclosed in the aforementioned U.S. Pat. Ser. No. 330,217 is a multiple-lane packaging machine and the web feed apparatus is arranged to support a plurality of web supply rolls WS for unwinding rotation. The parts of the web feed apparatus for each web supply roll are of like construction and like numerals are used to designate corresponding parts. As best shown in FIGS. 2 and 3, the supports for the web supply rolls each include a pair of arms 21 secured to opposite ends of a shaft 22 that is rotatably supported in bearings 23 on the support frame. The web supply rolls are supported by collets **24*a* on a mandrel 24 and the arms 21 have a notch 21*a* in their upper ends adapted to to receive the ends of the mandrel. The arms can be moved about the axis of shaft 22 from their normal roll support position engaging a stop 25, as shown in solid lines in FIGS. 2 and 3, to a loading position as shown in phantom at the lower left in FIG. 2. The web from each supply roll is passed over a web loop forming means or festooner means 31, a longitudinal web folder 32 and through a web feed apparatus 33 which is operative to feed the web when a pull is exerted on the web exiting from the web feed rollers. The web loop forming means 31 includes a plurality of web engaging rollers, herein shown four in number and designated 36–39 and mounted at a stationary location on the support frame. The loop forming means also includes a dancer having dancer rollers 41 and 42 supported on the distal end of a dancer arm 43, for vertical swinging movement about a pivot axis 44 on the support frame. The web from the supply roll is guided over a roller 45 and is passed over rollers 36, 37 and under dancer roller 41, over roller 38 and under dancer roller 42 and exits over roller 39. The dancer rollers 41 and 42 are gravitationally urged downwardly away from the loop guide rollers 36–39** and the number of plies of web that extend between the dancer rollers and the loop guide rollers is preferably made greater than two to increase the amount of web storage in the variable size web loop and to also decrease the web tension required to operate the dancer.

A brake means 51 is provided for controlling unwinding rotation of the web supply roll WS and is operated under the control of the dancer. The brake means 51 includes a flexible brake band 52 which is anchored at one end by a brake anchor member 53 on the support frame and which is guided at its other end over a roller 54 to cause the brake band to extend part way around the periphery of the supply roll. The roller 54 is conveniently disposed concentric with the shaft 22 of the roller support arms 21 and the roller 54 is located at the side of the web supply roll opposite the anchor 53. The end of the brake band 52 remote from the anchored end is connected through a flexible brake applying member 56 to a bracket 59 on the dancer arm, in a manner to draw the brake band against the periphery of the supply roll when the dancer arm moves downwardly to a position away from the loop guide means 36–39. As best shown in FIGS. 2 and 3, the flexible brake applying member 56 is entrained intermediate its ends over guides 57 and 58, with the guide 58 being disposed at a level above the point of attachment of the flexible member to the dancer, so that downward movement of the dancer draws the brake band against the periphery of the supply roll. A longitudinally extensible and contractable spring 60 is advantageously provided in the flexible brake applying member 56 and selected to have a spring tension such that it will elongate somewhat under the tension incurred during normal operation of the brake applying mechanism, to provide a more gradual application and release of the tension in the brake band. The brake band 52 may, for example, comprise a strip of rubber coated multiple ply fabric having width of the order of two to three inches, and the flexible brake applying member 56 can be of the same material and integrally joined to the brake band.

The longitudinal web folding apparatus 32 is in the form of a generally V-shaped folding plate 65 having its base mounted as by a bracket 65*a* adjacent the guide roller 39. The web W passes over the top of the V-shaped folding plate 65 and side portions of the web are guided off opposite converging sides of the plate between guide fingers 66 located adjacent the apex of the plate 65, into face-to-face contact. The longitudinally folded web WF exits from the folding plate with the fold line of the web disposed at an angle to the plane of the plate, and which angle is substantially complimentary to the angle between the converging edges of the plate. A means such as an adjustable screw 67 is provided for adjusting the angle of the plate 65.

Figure 1:
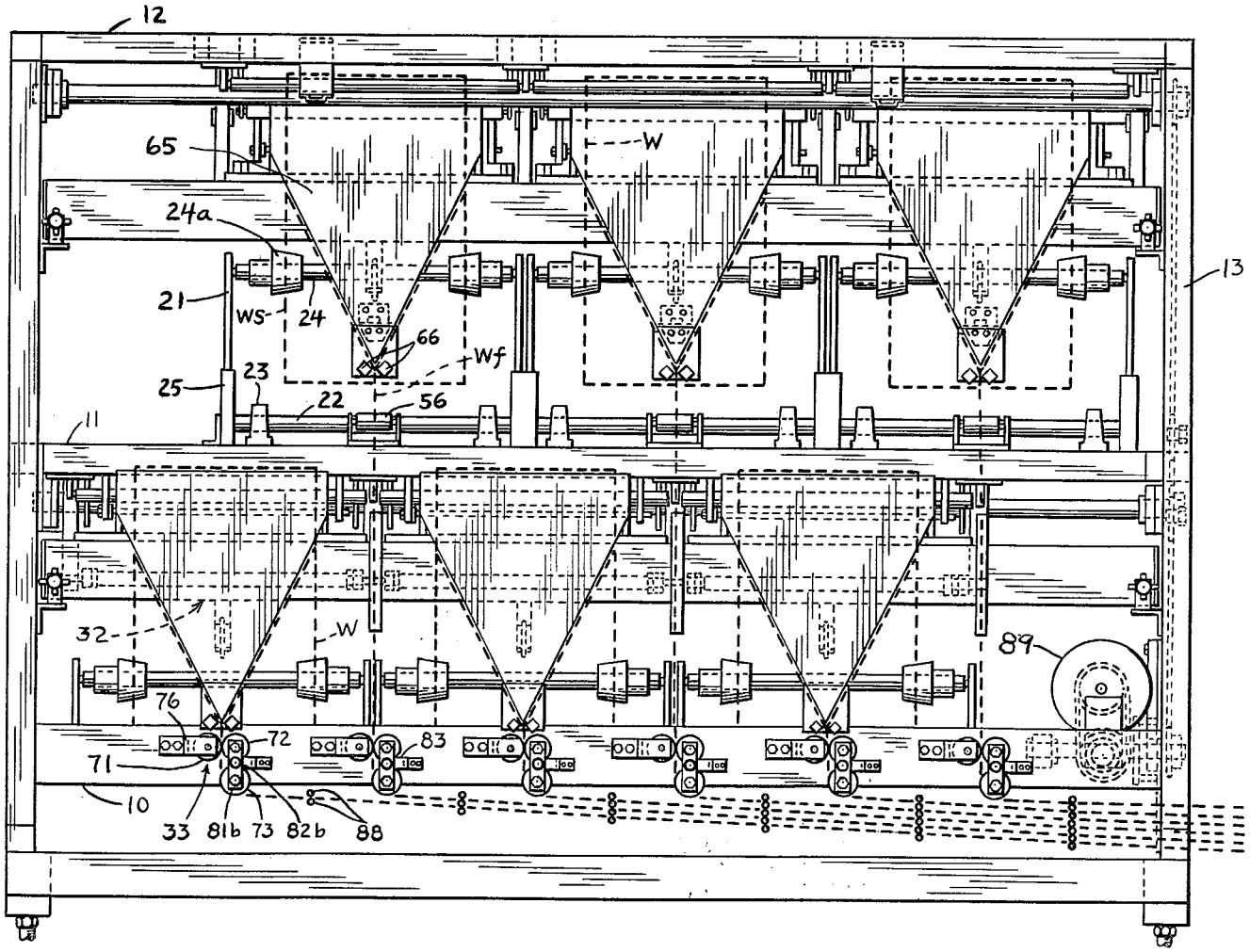
FIG. 1 is a front view of the web feed apparatus.
Figure 4:
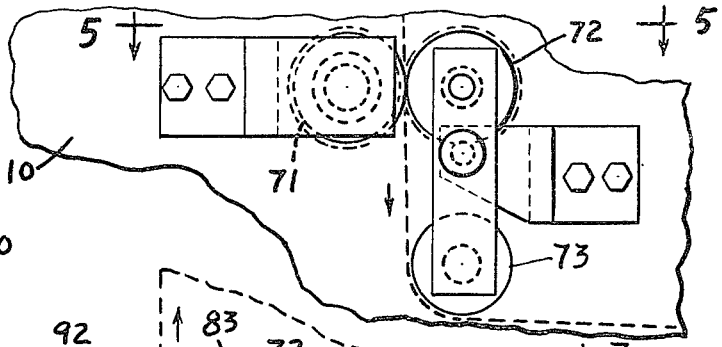
FIG. 4 is a fragmentary front elevational view through the web feed roller mechanism and illustrating the parts on a larger scale than FIG. 1.
Figure 5:
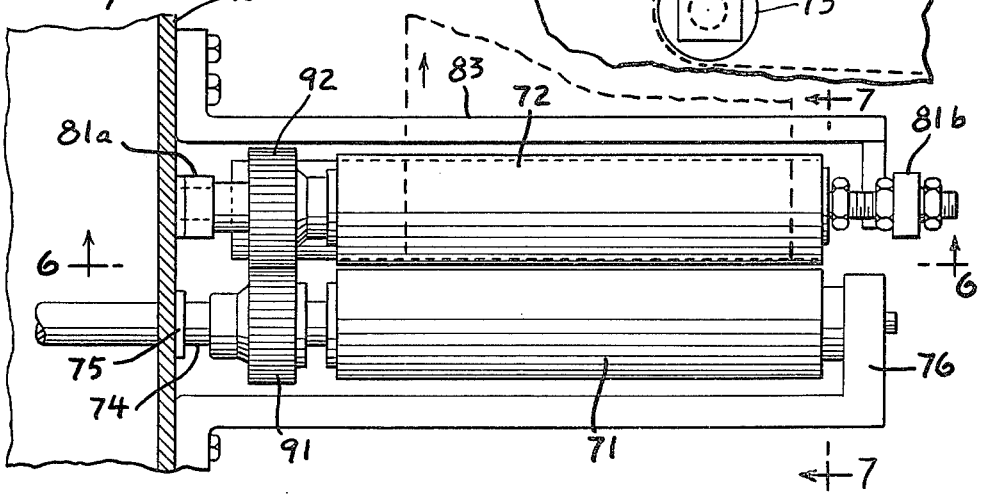
FIG. 5 is a fragmentary horizontal sectional view taken on the plane 5—5 of FIG. 4.
Figure 6:
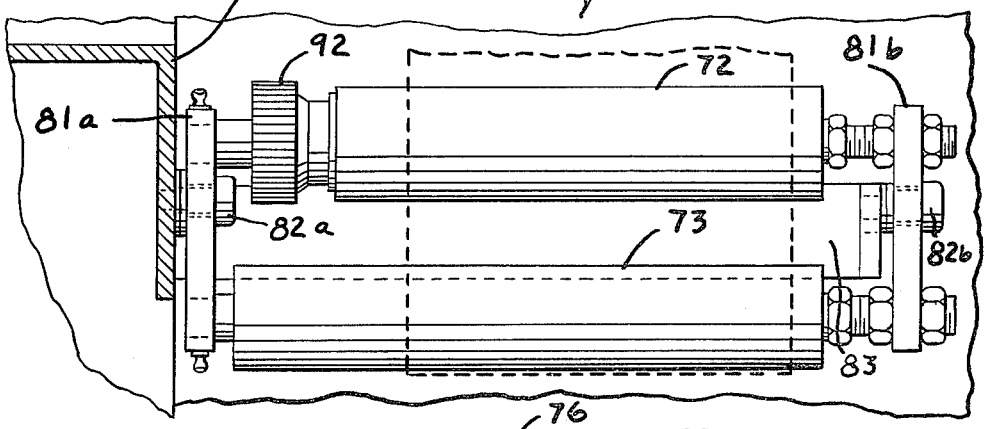
FIG. 6 is a fragmentary vertical sectional view taken on the plane 6—6 of FIG. 5.
Figure 7:
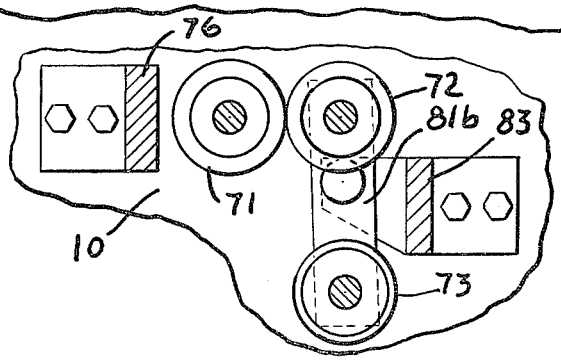
FIG. 7 is a fragmentary vertical sectional view taken on the plane 7—7 of FIG. 5, and illustrating the feed rollers in a feed position.

The web feed rollers 33 are disposed along the path of travel of the folded web exiting from the web folding plate 65. Each set of web feed rollers includes a first web feed roller 71 mounted for axial rotation at one side of the path of travel of the folded web exiting from the web folder, a second web feed roller 72 mounted at the other side of the path of travel of the folded web for movement toward and away from the first web feed roller 71, and an exiting web guide roller 73. As best shown in FIGS. 4 and 5, the web guide roller 71 is mounted on a shaft 74 that is rotatably supported by a bearing 75 and a bracket 76 on the support frame. Each shaft 74 is drivingly connected through a right angle gear drive 78 to a drive shaft 79. Each lever 81*a* is pivotally mounted intermediate its ends by a pivot pin 82*a* on the support frame and each lever 81*b* is pivotally mounted intermediate its ends on a bracket 83 attached to the support frame, and each feed roller 72 is rotatably mounted on one end of a pair of the levers 81*a*, 81*b* for movement toward and away from the associated feed roller 71. Each exiting web guide roller 73 is mounted on the other ends of each pair of the levers 81*a* and 81*b* with its periphery generally tangent to a plane extending between the associated first and second web feed rollers 71 and 72 to engage the folded web after it exits from the first and second feed rollers. Exiting web guide means including guide pins 88 (FIG. 1) are mounted on the frame and engage the folded web after it exits from each exiting web guide roller 73 to guide the folded web in an exiting direction having a substantial component extending laterally of the other side of the path of travel of the web passing between the feed rollers 71 and 72, to shift the second feed roller 72 toward the first feed roller in response to tension on the folded web exiting from the exiting web guide roller. Thus, when a pull is exerted on the web exiting from the roller 73, it causes the levers 81*a*, 81*b* to pivot about their pivot axis 82*a*, 82*b* and shift the respective feed roller 72 toward the feed roller 71 to drivingly engage the folded web between the feed rollers 72 and 71. Feed roller 72 is advantageously driven at the same speed as feed roller 71 to drive both sides of the folded web at the same speed. For this purpose, a drive gear 91 is provided on the shaft 74 for feed roller 71 and a drive gear 92 is provided on the shaft of feed roller 72, and arranged to mesh with the gear 91, when the feed rollers 71 and 72 are in driving engagement with opposite sides of the folded web as well as when the feed roller 72 is shifted away from the feed roller 71. With this arrangement, the feed rollers 71 and 72 not only drive both sides of the folded web, but also effect feeding in a manner that the folded web remains planar as it passes between the feed rollers. Thus, both sides of the folded web are under the same tension as the web passes between the feed rollers so that wrinkling and creasing of the folded web is effectively avoided.

As best shown in FIG. 2, the drive shaft 79 for the feed rollers is driven from a drive motor 89 through a belt drive 90, clutch 93, coupling 94 and right angle speed reducer drive 95. In some installations, it is advantageous to aid in feeding material from the supply roll into the storage loop formed by the dancer and provision is advantageously made for driving one of the guide rollers 37 at a speed correlated with the speed of the feed rollers 71 and 72. As best shown in FIG. 2, a roller 37 has a sprocket 101 that is connected through a chain 102 to a sprocket (not shown) on the drive shaft 79, with the chain being guided intermediate its ends over idler sprockets 104–106. Guide roller 36 is mounted on a bracket 36*a* for adjustment relative to the roller 37, to adjust the amount of wrap of the web around the roller 37. As shown in the drawings, the roller 36 is adjusted so that the web has only a small angle of wrap around the roller 37, and the amount of wrap and hence the amount of feeding of the web by the roller 37 can be increased by moving the roller 36 to the left which increases the wrap around roller 37, and conversely decreased by moving the roller 36 to the right to decrease the wrap of the web around roller 37.

From the foregoing it is thought that the construction and operation of the web feed apparatus will be readily understood. When the feeding of the web material is interrupted, the dancer moves downwardly away from the guide rollers 36–39 to a position in which it draws the flexible brake band 52 against the periphery of the supply roll to retard unwinding rotation of the supply roll. When the processing machine exerts a pull on the web exiting from the feed rollers, the feed roller 72 is moved toward feed roller 71 to drivingly engage the folded web therebetween and pull a quantity of the web material from the storage loop formed by the dancer past the web folder. The dancer is gravitationally urged downwardly and, when web material is withdrawn from the storage loop at a rate faster than the web unwinds from a supply roll, the dancer moves upwardly and reduces the tension applied through the flexible brake applying member 56 to the brake band 52. Conversely, when the feeding of the web material by the feed rolls is interrupted, the inertia of the supply roll tends to cause it to continue to rotate and supply material to the storage loop. The dancer arm then moves downwardly and increases the tension applied through the brake applying member 56 to the brake band, to retard rotation of the supply roll. In this manner, the braking action on the web supply roll is cyclically decreased and increased as web material is intermittently fed by the feed rolls 71, 72. Further, as the size of the supply roll decreases, the braking action applied by the brake band also decreases. Since the brake band engages the periphery of the supply roll, the radius on which the braking action is applied decreases as the diameter of the supply roll decreases, and this decreases the braking action with the decreasing size of the supply roll. In addition, as will be seen from a comparison of FIGS. 2 and 3, the angle of wrap of the brake band around the periphery of the supply roll, also decreases as the diameter of the supply roll decreases, and this also contributes to reducing the braking action on the supply roll with decreasing roll size.

The braking of the unwinding rotation of the supply roll in response to the tension sensed by the dancer in the exiting web, operates to maintain a tension in the web passing to the longitudinal web folding apparatus 32. This is important to maintain lateral tracking of the web. The amount of tension maintained in the web can be controlled by adjusting the weight or bias exerted by the dancer on the web and by selecting the number of plies or passes that the web makes between the dancer and the loop guides.

The embodiments of the invention in which an exclusive property or privilege is claimed are defined as follows:

1. An apparatus for feeding a web of material from a supply roll to web processing euipment of the type that exerts an intermittent pulling force on the web during intermittent advance through the processing equipment, the apparatus including, a support frame means for supporting a supply roll of web material on the frame for unwinding rotation, web loop forming means including loop guide means mounted at a stationary location on the frame and dance means mounted on the frame for movement toward and away from the loop guide means and adapted to form a variable size loop in the web passing between the dancer means and the loop guide means, a flexible brake band means, means anchoring one end of the brake band means on the frame and means guiding the other end of the brake band means to cause the brake band means to extend part way around the periphery of the supply roll, brake applying means including a longitudinally extensible and contractable spring means operatively connected at one end to said dancer means and at its other end to the other end of the brake band means and constructed and arranged to draw the brake band means against the periphery of the supply roll when the dancer means moves to a position away from the loop guide means, the dancer means being yieldably biased in a direction away from the loop guide means to apply tension through the longitudinally extensible and contractable spring means to the brake band means, the dancer means being constructed and arranged to move toward the loop guide means and reduce tension applied to the brake band means when the web is drawn from the loop forming means at a rate faster than the web unwinds from the supply roll, outlet web feed roller means engageable with the web after it exits from the web loop forming means and operative when a pull is exerted on the web exiting from the web feed roller means to draw the web from the web loop forming means, web folding means engaging the web at a location between the web loop forming means and the outlet web feed roller means for longitudinally folding the web to form a longitudinally folded web that exits from the web folding means along a linear path of travel, said outlet web feed roller means including first and second relatively parallel feed rollers and an exiting web guide roller, means mounting the first web feed roller on the frame for axial rotation at one side of said linear path of travel of the folded web exiting from the web folding means, lever means mounted on frame for pivotal movement about an axis at the other side of said linear path of travel of the folded web, means mounting the second web feed roller at the other side of said linear path on one end of the lever means for movement along a path generally perpendicular to said linear path of travel of the folded web toward and away from the first web feed roller, means mounting the exiting web guide roller on the other end of said lever means with its periphery generally tangent to a plane extending between the first and second web feed rollers and in the direction of said linear path of travel to engage the folded web exiting from the first and second feed rollers and maintain the folded web substantially in said linear path of travel as it exits between the first and second feed rollers, means including intermeshing gear means on the first and second feed rollers for driving the first and second feed rollers at the same speed and in directions to advance the folded web, and exiting web guide means engageable with the folded web after it exits from the exiting web guide roller for guiding the folded web in an exiting direction having a substantial component laterally of said other side of said linear path of travel to shift the second feed roller toward the first feed roller in response to tension on the folded web exiting from the exiting web guide roller.

2. An apparatus for feeding a web of material from a supply roll according to claim 1 including an inlet web feed roller means mounted for axial rotation on the frame, inlet web guide means for guiding the web after it exits from the supply roll to cause the web to wrap part way around the inlet web feed roller means, means for driving the inlet web feed roller means in continuous fashion.

3. An apparatus for feeding a web of material from a supply roll according to claim 2 wherein said inlet web guide means includes a web guide mounted on the frame for adjustment relative to the inlet web feed roller means to adjust the angle of wrap of the web around the inlet web feed roller means.

4. An apparatus for feeding a web of material from a supply roll to processing equipment of the type that exerts an intermittent pulling force on the web during intermittent advance through the processing equipment, the apparatus including, a support frame, means for supporting a supply roll of web material on the frame for unwinding rotation, web loop forming means including loop guide means and dancer means mounted on the frame for movement toward and away from the loop guide means and adapted to form a variable size loop in the web passing between the dancer means and the loop guide means, brake means for controlling unwinding rotation of the supply roll, means connecting the brake means to the dancer means and constructed and arranged to apply the brake means when the dancer means moves to a position away from the loop guide means and to release the brake means when the web is drawn from the loop forming means at a rate faster than the web unwinds from the supply roll, web feed roller means engageable with the web after it exits from the web loop forming means and operative when a pull is exerted on the web exiting from the web feed roller means to draw the web from the web loop forming means, web folding means engaging the web at a location between the web loop forming means and the web feed roller means for longitudinally folding the web as it passes thereover to form a longitudinally folded web that exits from the web folding means along a linear path of travel, said web feed roller means including first and second relatively parallel feed rollers and an exiting web guide roller, means mounting the first web feed roller on the frame for axial rotation at one side of said linear path of travel of the folded web exiting from the web folding means, lever means mounted on frame for pivotal movement about an axis at the other side of said linear path of travel of the folded web, means mounting the second web feed roller at the other side of said linear path of travel on one end of the lever means for movement along a path generally perpendicular to said linear path of travel of the folded web toward and away from the first web feed roller, means mounting the exiting web guide roller on the other end of said lever means with its periphery generally tangent to a plane extending between the first and second web feed rollers and in the direction of said linear path of travel to engage the folded web exiting from the first and second feed rollers and maintain the folded web substantially in said linear path of travel as it exits between the first and second feed rollers, means including intermeshing gear means on said first and second feed rollers for driving the first and second feed rollers at the same speed and in directions to advance the folded web, and exiting web guide means engageable with the folded web after it exits from the exiting guide roller for guiding the folded web in an exiting direction having a substantial component laterally of said other side of said linear path of travel to shift the second feed roller toward the first feed roller in response to tension on the folded web exiting from the exiting web guide roller.

* * * * *